US012139854B2

(12) United States Patent
Schmid

(10) Patent No.: US 12,139,854 B2
(45) Date of Patent: Nov. 12, 2024

(54) REFINER PLATE SEGMENT

(71) Applicant: Voith Patent GmbH, Heidenheim (DE)

(72) Inventor: Martin Schmid, Argenbühl (DE)

(73) Assignee: Voith Patent GmbH, Heidenheim (DE)

( * ) Notice: Subject to any disclaimer, the term of this patent is extended or adjusted under 35 U.S.C. 154(b) by 556 days.

(21) Appl. No.: 17/406,428

(22) Filed: Aug. 19, 2021

(65) Prior Publication Data

US 2021/0381164 A1 Dec. 9, 2021

Related U.S. Application Data

(63) Continuation of application No. PCT/EP2019/085613, filed on Dec. 17, 2019.

(51) Int. Cl.
*D21D 1/30* (2006.01)

(52) U.S. Cl.
CPC ..... *D21D 1/306* (2013.01); *D21D 1/30* (2013.01)

(58) Field of Classification Search
CPC . D21D 1/306; D21D 1/30; D21D 1/22; B02C 7/12
See application file for complete search history.

(56) References Cited

U.S. PATENT DOCUMENTS 1,662,572 A * 7/1926 Fryer ..... D21D 1/306 241/261.3
3,104,837 A * 9/1963 Steiniger et al. ..... D21D 1/306 241/296
3,125,306 A * 3/1964 Kollberg et al. ..... D21D 1/306 241/300
4,157,669 A * 6/1979 Pilao ..... D21D 1/306 76/115
4,274,602 A * 6/1981 Johansson ..... B02C 7/12 241/300

(Continued)

FOREIGN PATENT DOCUMENTS

DE 10 2004 016 661 A1 10/2005
DE 10 2010 029 752 A1 12/2011

(Continued)

OTHER PUBLICATIONS

Notification of the Transmission of the International Search Report and Written Opinion of the International Search Authority or Declaration dated Mar. 25, 2020 for International Application No. PCT/EP2019/085613 (10 pages).

*Primary Examiner* — Stephen Hobson
(74) *Attorney, Agent, or Firm* — Taylor IP, P.C.

(57) ABSTRACT

A plate segment for refining an aqueously suspended fibrous material in a refining gap delimited by two treatment surfaces rotating relative to each other and formed by a plurality of the plate segment, includes: a basic body including: a plurality of elongate treatment elements which face the refining gap and run radially at least with one directional component; a plurality of grooves running between the plurality of elongate treatment elements, the plurality of grooves including a groove base; and a plurality of channels running at least with one directional component radially and at least approximately parallel to the refining gap, being at different distances from the refining gap and arranged in the basic body, and at least partially overlapping one of one another and with the groove base in a direction of rotation.

20 Claims, 1 Drawing Sheet

(56) References Cited

U.S. PATENT DOCUMENTS 5,046,672 A * 9/1991 Demler ..... D21D 1/306 241/296
5,201,917 A * 4/1993 Brunet ..... B29C 43/006 51/298
5,893,525 A * 4/1999 Gingras ..... D21D 1/306 241/261.3
5,934,585 A * 8/1999 Chaney ..... D21D 1/30 241/261.2
5,988,538 A * 11/1999 Bartels ..... D21D 1/306 241/261.2
6,607,153 B1 * 8/2003 Gingras ..... B02C 7/12 241/261.3
8,006,924 B2 * 8/2011 Johansson ..... D21D 1/30 241/298
9,145,641 B2 * 9/2015 Gingras ..... D21D 1/30
10,400,393 B2 * 9/2019 Hawén ..... D21D 1/22
2002/0070303 A1 * 6/2002 Johansson ..... B02C 7/12 241/261.3
2006/0006264 A1 * 1/2006 Sabourin ..... D21D 1/30 241/261.2
2007/0164143 A1 * 7/2007 Sabourin ..... D21D 1/306 241/297
2007/0210197 A1 * 9/2007 Carpenter ..... B02C 7/12 241/298
2009/0045278 A1 * 2/2009 Bech ..... D21D 1/306 241/297
2009/0302140 A1 * 12/2009 Johansson ..... D21D 1/306 241/27
2011/0198423 A1 * 8/2011 Lindroos ..... D21D 1/26 241/30
2011/0253327 A1 * 10/2011 Crasser ..... D21D 1/303 162/261
2012/0032011 A1 * 2/2012 Ruola ..... D21D 1/306 241/291
2013/0001334 A1 * 1/2013 Johansson ..... B02C 7/12 241/291
2013/0015281 A1 * 1/2013 Gingras ..... D21D 1/306 241/296
2013/0270377 A1 * 10/2013 Gingras ..... D21D 1/306 241/220
2013/0320119 A1 * 12/2013 Gingras ..... D21D 1/306 241/298
2014/0077016 A1 * 3/2014 Gingras ..... B02C 7/12 241/298
2014/0110511 A1 * 4/2014 Antensteiner ..... D21D 1/306 241/261.3
2014/0131489 A1 * 5/2014 Gingras ..... D21D 1/306 241/296
2014/0196858 A1 * 7/2014 Gingras ..... B02C 7/12 162/4
2014/0217218 A1 * 8/2014 Huhtanen ..... D21D 1/22 241/261.3
2016/0138220 A1 * 5/2016 Gingras ..... D21D 1/30 241/298
2016/0145798 A1 * 5/2016 Sjöström ..... D21D 1/306 241/298
2016/0355977 A1 * 12/2016 Hawén ..... B02C 7/02
2017/0073893 A1 * 3/2017 Bilodeau ..... D21D 1/306
2017/0191218 A1 * 7/2017 Tichy ..... D21D 1/30
2017/0320063 A1 * 11/2017 Sjöström ..... D21D 1/306
2017/0362773 A1 * 12/2017 Lindblom ..... D21C 3/222
2018/0251942 A1 * 9/2018 Gottschalk ..... F16L 21/03
2020/0283955 A1 * 9/2020 Gottschalk ..... F16L 21/02
2024/0182103 A1 * 6/2024 Bast ..... B62D 1/046

FOREIGN PATENT DOCUMENTS

EP 480851 A * 4/1992 ..... B02C 7/12
EP 3 398 682 A1 11/2018
GB 2157974 A * 11/1985 ..... B02C 7/12
WO WO-9524528 A1 * 9/1995 ..... D21D 1/306
WO WO-2006091063 A1 * 8/2006 ..... B02C 7/12
WO WO-2009153412 A1 * 12/2009 ..... D21D 1/22
WO WO-2009153413 A1 * 12/2009 ..... D21D 1/24
WO WO-2013133750 A1 * 9/2013 ..... B02C 7/12
WO WO-2016169672 A1 * 10/2016 ..... B02C 7/06

* cited by examiner

REFINER PLATE SEGMENT

CROSS REFERENCE TO RELATED APPLICATIONS

This is a continuation of PCT application No. PCT/EP2019/085613, entitled "REFINER PLATE SEGMENT", filed Dec. 17, 2019, which is incorporated herein by reference.

BACKGROUND OF THE INVENTION

1. Field of the Invention

The present invention relates to refiners, and, more particularly, to plate segments of refiners.

2. Description of the Related Art

The present invention relates to a plate segment for refining aqueously suspended fibrous material in a refining gap delimited by two treatment surfaces rotating relative to each other and formed by plate segments, including a basic body with elongate treatment elements which face the refining gap and run radially at least with one directional component and with grooves running in-between.

The present invention also relates to a treatment surface including a plurality of plate segments arranged next to one another, and a method for producing a plate segment for refining aqueously suspended fibrous material in a refining gap, including a basic body with treatment elements facing the refining gap.

Plates of this type have been known for a long time and are installed in refining machines—what are called refiners. The slurry in refiners has a solids content of approximately 2-8%.

Such machines generally have at least one rotor and at least one stator with either disk-shaped or conical treatment surfaces on which the plates are attached such that refining gaps can be formed between them. The plates have webs and grooves on the treatment surfaces, and therefore "blade plates" are also talked of.

The plates are subject to a high degree of wear and therefore have to be replaced at certain intervals. The wear can also lead during the service life to the processing action changing.

A considerable portion of the operating costs that arise during the mechanical treatment of fibrous materials in the pulp and paper industry comes from the energy costs. It has therefore always been endeavored to construct and to operate plates and the machines used to the effect that a not too high use of energy is required, as measured by the desired success.

It is therefore understandable that a considerable outlay is expended on the development of plates, this being reflected in the configuration of the shape of the plates and in the selection of the material.

In order to reduce the outlay on production of the plates, it is proposed, for example in DE 10 2004 016 661 A1, to assemble the plates from a plurality of elements and then to weld or to braze them to one another.

What is needed in the art is to extend the service life of such plate segments with the refining being as efficient as possible.

SUMMARY OF THE INVENTION

The present invention provides a multiplicity of channels running at least with one directional component radially and at least approximately parallel to the refining gap and each being at different distances from the refining gap that are arranged in the basic body, said channels at least partially overlapping one another or with the groove base, as viewed in the direction of rotation.

If, during the operation, complete abrasion of the treatment elements occurs as a consequence of wear, this leads at the same time to the opening of the channels which partially overlap with the groove base in the direction of rotation. The abrasion of the wall of said channels that faces the refining gap leads to said channels now acting as a groove and to the surface lying between the opened channels acting as a treatment element.

Therefore, the width of the channels should substantially correspond to the width of the grooves, and/or the width of the wall between channels which are adjacent in the direction of rotation should substantially correspond to the width of the treatment elements.

Furthermore, the channels should each run at least approximately parallel to at least one elongate treatment element lying axially somewhat thereabove.

A slight inclination of the channels toward the refining gap may also be advantageous. If the channels are inclined radially outward toward the refining gap, the channels first of all open radially on the outside in the event of wear.

It is thereby ensured that, even if the wear increases, there is a sufficiently large open groove surface and the required cutting edge length of the treatment elements.

Ideally, the configuration and/or arrangement of the channels of the treatment surface, of the plate segment or of one zone thereof is selected in such a manner that the open surface of the grooves and/or the cutting edge length remains approximately identical throughout the entire service life, and therefore even the no-load power remains approximately the same throughout the entire service life.

In order to achieve this, it can be advantageous if the groove base of adjacent grooves differs in depth. The adjacent grooves here advantageously differ in depth not only in the starting state, but also during the wear.

For this purpose, it has proven advantageous structurally if in the basic body there are a plurality of planes which lie one above another and are at least approximately parallel to the refining gap and each has a plurality of channels.

The channels of adjacent planes should run offset with respect to one another here in the direction of rotation in such a manner that they partially overlap, as viewed in the direction of rotation.

Irrespective thereof, for homogeneous refining, the grooves should have at least predominantly a constant width, and/or the width of the treatment elements should be at least predominantly the same size.

For an intensive refining, it is advantageous if the width of the treatment elements is between 0.1 and 1.5 mm, and/or the height of the treatment elements is less than 5 mm.

For the purpose of optimizing their arrangement and their effect, the elongate treatment elements and the channels advantageously run unevenly at least in sections.

The generally circular or circular-ring-shaped treatment surfaces are generally composed of a plurality of plate segments. The circle diameter of the basic body here should be between 35 and 150 cm.

In order to have available a sufficiently large number of grooves and treatment elements during each state of wear of the treatment surface, it can be advantageous to arrange and/or to configure the channels of adjacent plate segments differently, and therefore a sufficiently large number of channels is opened for each state of wear. In addition, the average number and the cumulated width of the treatment elements can thus be kept constant.

For this purpose, it can be advantageous if at least some of the channel planes of at least two adjacent plate segments are at differing distances from the refining gap.

With regard to the method for producing the plate segments according to the present invention, it is essential that the treatment elements are at least partially, optionally completely, and, advantageously also the basic body is at least partially, applied layer by layer from one or more liquid and/or pasty and/or solid materials and, in the process, are subject to a physical or chemical hardening or melting process. Sintering is also included by said hardening or melting process.

The application layer by layer enables material and shape of the treatment elements and of the channels to be more simply and comprehensively adapted to the specific requirements.

It has to be noted here that a shrinkage of up to 30% may occur depending on the applied material and the specific hardening or melting process.

Due to the high loading in machines of this type for refining fibrous materials, the material applied layer by layer should be pulverulent and/or should include one or more metals or metal compounds.

It is advantageous here if the material which is applied layer by layer is sintered or melted by way of a laser.

Ceramic layers can also be produced in this manner.

Furthermore, the surface roughness of the treatment element can be influenced by the grain size of the powder.

To intensify the treatment, the production method according to the invention, in contrast to the previously conventional casting, permits very narrow treatment elements and equally small distances between adjacent treatment elements.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
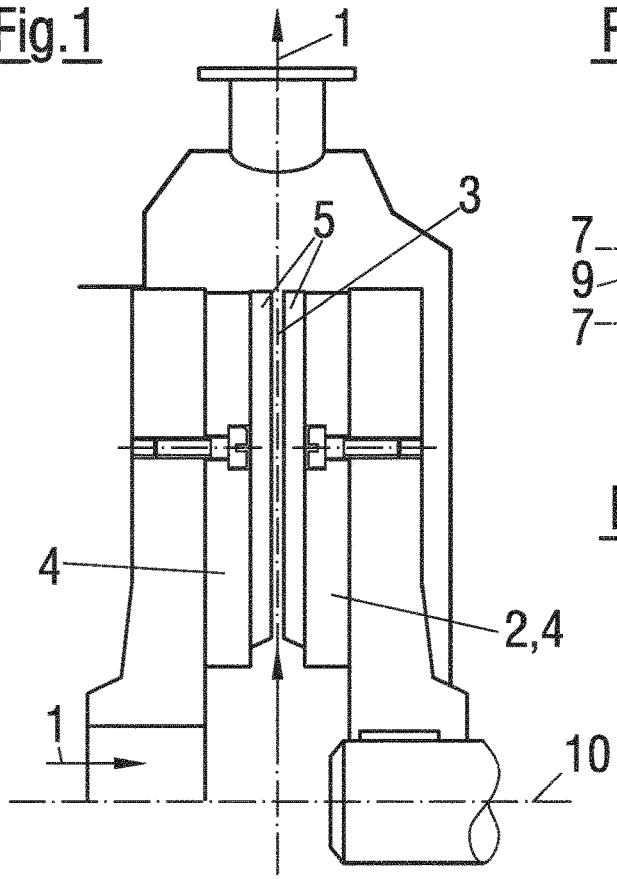
FIG. 1 is a schematic cross-section through a refining arrangement.

Referring now to the drawings, according to FIG. 1, in the housing of the refining arrangement, a refining gap 3 is formed by a stationary refining surface coupled to the housing and by a refining surface rotating about an axis of rotation 10.

The two circular-ring-shaped refining surfaces (treatment surfaces) run parallel to each other here, with the distance between them generally being adjustable. In addition to the flat treatment surfaces shown here, conical treatment surfaces are also possible.

The rotating refining surface is moved in the direction of rotation by a shaft which is mounted rotatably in the housing. Said shaft is driven by a drive which, by way of example, is likewise present in the housing.

In the example shown, the fibrous slurry 1 to be refined passes via an inlet through the center into the refining gap 3 between the two refining surfaces. However, feeding via openings in the refining surface is also possible.

The fibrous slurry 1 passes the interacting refining surfaces radially outward and leaves the adjoining annular space through an outlet.

The ways which are known per se and with which a force is generated in order to press the two refining surfaces against each other are not illustrated.

Figure 2:
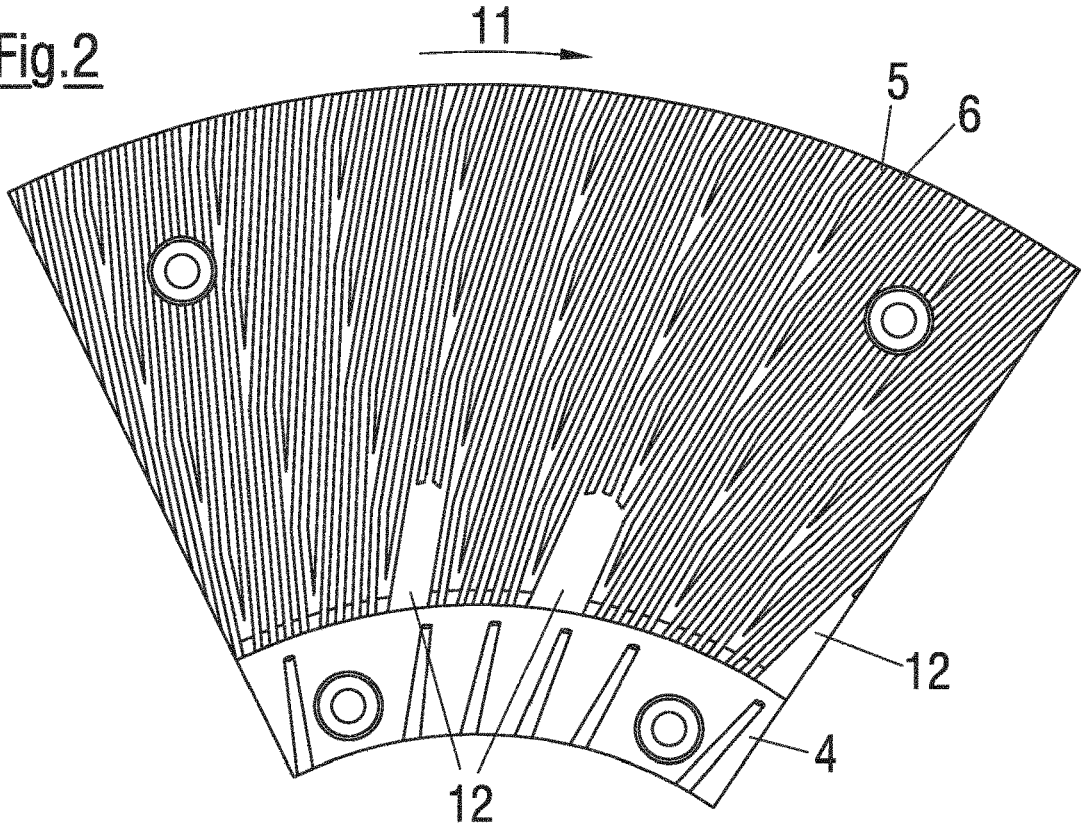
FIG. 2 is a top view of a plate segment 2 of the refining arrangement.

The two refining surfaces are each formed by a plurality of refiner plate segments 2 which, according to FIG. 2, are in the shape of a circular segment or circular-ring segment and extend over a respective circumferential segment of the corresponding refining surface and are arranged in a row next to one another in the circumferential direction.

As shown in FIG. 2, the plate segments 2 are each formed by a base plate 4 having a multiplicity of strip-shaped treatment elements 5 running substantially radially and grooves 6 lying in-between.

Parallel to the base surface 4 the treatment elements 5 have an elongate cross-sectional shape, with the upper side of the treatment elements 5 that faces the treatment gap 3 generally running parallel to the outer surface of the basic body 4.

For the purpose of optimizing their arrangement and their effect, the treatment elements 5 frequently run unevenly, i.e. in a curved, corrugated or, as can be seen in FIG. 2, bent manner, at least over a radial portion.

In order to reduce the production costs of the plate segments 2, the basic body 4 and the treatment elements 5 of the plate segments 2 are completely applied layer by layer from a liquid, pasty or solid material and, in the process, subjected to a physical or chemical hardening or melting process.

This means that the materials can be selected in accordance with the specific stresses and requirements.

Due to the extremely high stress in machines for treating fibrous material 1, the application layer by layer of pulverulent material which includes ceramic or one or more metals or metal compounds is particularly suitable. Said material applied layer by layer can then be sintered or melted by way of laser after each layer or, in a first step, adhesively bonded with binder and sintered later (binder jetting method). In the latter method, the binder is evaporated.

The arrangement of the treatment elements 5 on the basic body 4 can be selected here in accordance with requirements.

The circular diameter of the basic body 4 is between 35 and 150 cm.

Figure 3:
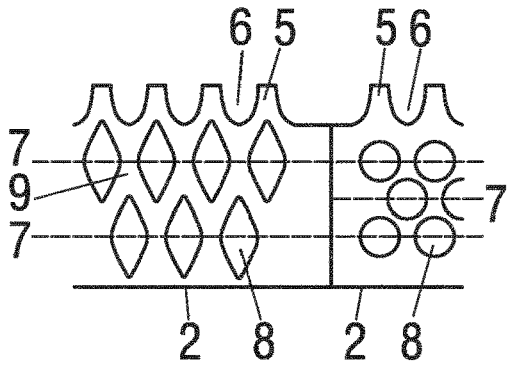
FIG. 3 is a partial cross-section through two adjacent plate segments 2.

As shown in FIG. 3, a multiplicity of channels 8 running at least with one directional component radially and parallel to the refining gap 3 and being in each case at different distances from the refining gap 3 are arranged in the basic body 4, said channels partially overlapping one another or with the groove base, as viewed in the direction of rotation 11.

The production of said basic body 4 is substantially facilitated by the application layer by layer.

If complete abrasion of the treatment elements 5 occurs as a result of wear during the refining treatment, this leads because of the overlap with the groove base to the opening of the channels 8 lying closest to the refining gap 3. This in turn has the result that the opened channels 8 now act as a groove 6, and the wall 9 between the opened channels 8 acts as a treatment element 5.

If the wall 9 between said first opened channels 8 is also abraded, the mutual partial overlapping means that further channels 8 are opened, the wall 8 of which takes on the function of the treatment elements 5.

In order to be able to ensure an identical treatment of the fibrous material 1 even as the wear increases, the channels 8 should each run at least approximately parallel to an elongate treatment element 5 lying axially approximately thereabove. A slight inclination of the channels 8 toward the refining gap 3, in particular radially outward, can be advantageous for the flow through them.

For reliable, homogeneous and efficient refining, the grooves 6 have at least predominantly a constant width. The width of the treatment elements 5 also remains at least predominantly the same size in the radial direction.

In order also to ensure this when the channels 8 or the wall 9 thereof take over the function of said grooves, the width of the channels 8 substantially corresponds to the width of the groove 6, and the width of the wall 9 between channels 8 which are adjacent in the direction of rotation 11 substantially corresponds to the width of the treatment elements 5.

In order to ensure as high a number and as consistent a number of opened channels 8 as possible during the wear of the basic body 4, in the basic body 4 there are a plurality of planes 7 which lie one above another and are parallel to the refining gap 3, and each have a plurality of channels 8. The planes 7 illustrated in FIG. 3 run through the center, lying in the axial direction, of the channels 8.

The channels 8 of adjacent planes 7 are arranged here offset from one another in the direction of rotation 11. Furthermore, the channels 8 of adjacent planes 7 partially overlap in the direction of the rotation 11 such that, when a wall 9 is completely abraded, the adjacent channel 8 lying axially therebelow is opened.

By way of example, the height of the treatment elements 5 here is below 3 mm and the width of the treatment elements 5 is between 0.1 and 1 mm.

In order, during each state of wear, to be able to ensure an open groove surface which is as equally high as possible and a cutting edge length of the treatment elements 5 that is the same size as far as possible, it can be helpful, as can be seen in FIG. 3, to arrange the channels 8 of adjacent plate segments 2 differently and to configure them differently.

Thus, as shown there, at least some of the planes 7 of two adjacent plate segments 2 are at differing distances from the refining gap 3.

Additionally or alternatively, however, the cross sections of the channels 8 of adjacent plate segments 2 can also differ. While the channels 8 of the one plate segment 2 are circular, the channels 8 of the adjacent plate segment 2 have here by way of example an elliptical cross section.

In addition, it is, of course, also possible for the plate segments 2 themselves to have differently configured zones, wherein the channels 8 of said zones are arranged differently and/or are configured differently.

Furthermore, FIG. 2 shows supply channels 12 which reach radially outward into the refining surface and, because of the absence of treatment elements 5, assist the supply of fibrous slurry 1 into the refining gap 3.

Figure 4:
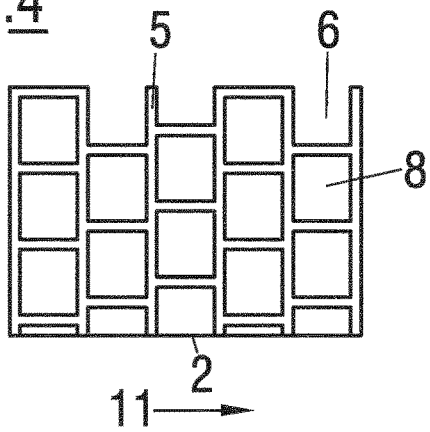
FIG. 4 is a partial cross-section through a different plate segment 2.

In contrast thereto, FIG. 4 shows axially offset channels 8 with a rectangular cross section. The aim here too is to ensure an open surface and cutting edge length of equal height in each state of wear.

It is essential here that the adjacent grooves 6 differ in depth in the starting state and during the wear.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A plate segment for refining an aqueously suspended fibrous material in a refining gap delimited by two treatment surfaces rotating relative to each other and formed by a plurality of the plate segment, the plate segment comprising:

a basic body including:

a plurality of elongate treatment elements which face the refining gap and run radially at least with one directional component;

a plurality of grooves running between the plurality of elongate treatment elements, the plurality of grooves including a groove base; and a plurality of channels running at least with one directional component radially and at least approximately parallel to the refining gap, being at different distances from the refining gap and arranged in the basic body, and at least partially overlapping one of one another and with the groove base in a direction of rotation.

2. The plate segment of claim 1, wherein in the basic body there are a plurality of planes which lie one above another and are at least approximately parallel to the refining gap, and each of the plurality of planes has respective ones of the plurality of channels.

3. The plate segment of claim 2, wherein respective ones of the plurality of grooves have at least predominantly a constant width.

4. The plate segment of claim 2, wherein a width of respective ones of the plurality channels substantially corresponds to a width of respective ones of the plurality of grooves.

5. The plate segment of claim 2, wherein a width of respective ones of the plurality of elongate treatment elements is at least predominantly a same size.

6. The plate segment of claim 2, wherein the basic body includes a wall, a width of the wall between respective ones of the plurality of channels which are adjacent in the direction of rotation substantially corresponds to a width of the plurality of elongate treatment elements.

7. The plate segment of claim 2, wherein respective ones of the plurality of channels of adjacent ones of the plurality of planes run offset with respect to one another in the direction of rotation so as to partially overlap in the direction of rotation.

8. The plate segment of claim 2, wherein at least one of (a) a width of respective ones of the plurality of elongate treatment elements is between 0.1 and 1.5 mm and (b) a height of respective ones of the plurality of elongate treatment elements is less than 5 mm.

9. The plate segment of claim 2, wherein a depth of adjacent ones of the plurality of grooves differs relative to one another.

10. The plate segment of claim 2, further including a plurality of sections, wherein the plurality of elongate treatment elements and the plurality of channels run unevenly at least in the plurality of sections of the plate segment.

11. The plate segment of claim 2, wherein each one of the plurality of channels runs parallel to at least one of the plurality of elongate treatment elements lying axially approximately thereabove.

12. The plate segment of claim 2, wherein each of the plurality of grooves includes an open surface and each of the plurality of elongate treatment elements includes a cutting edge length, wherein the plurality of channels are at least one of configured and arranged in such a manner that at least one of the open surface and the cutting edge length is approximately constant during a wear throughout an entire service life.

13. The plate segment of claim 2, wherein the plurality of channels are slightly inclined one of (a) toward the refining gap and (b) toward the refining gap radially outward.

14. A treatment surface, comprising:

a plurality of plate segments arranged next to one another and configured for refining an aqueously suspended fibrous material in a refining gap delimited by two of the treatment surface rotating relative to each other, each one of the plurality of plate segments including:

a basic body including:

a plurality of elongate treatment elements which face the refining gap and run radially at least with one directional component;

a plurality of grooves running between the plurality of elongate treatment elements, the plurality of grooves including a groove base; and a plurality of channels running at least with one directional component radially and at least approximately parallel to the refining gap, being at different distances from the refining gap and arranged in the basic body, and at least partially overlapping one of one another and with the groove base in a direction of rotation, the plurality of channels of adjacent ones of the plurality of plate segments being at least one of arranged and configured differently.

15. The treatment surface of claim 14, wherein in the basic body there are a plurality of planes which lie one above another and are at least approximately parallel to the refining gap, and each of the plurality of planes has respective ones of the plurality of channels, at least a part of the plurality of planes of at least two adjacent ones of the plurality of plate segments being at differing distances from the refining gap.

16. A method for producing a plate segment for refining an aqueously suspended fibrous material in a refining gap delimited by two treatment surfaces rotating relative to each other and formed by a plurality of the plate segment, the method comprising the steps of:

providing that the plate segment includes:

a plurality of elongate treatment elements which face the refining gap and run radially at least with one directional component;

a plurality of grooves running between the plurality of elongate treatment elements, the plurality of grooves including a groove base; and a plurality of channels running at least with one directional component radially and at least approximately parallel to the refining gap, being at different distances from the refining gap and arranged in the basic body, and at least partially overlapping one of one another and with the groove base in a direction of rotation; and applying the plurality of elongate treatment elements at least partially layer-by-layer from at least one material that is at least one of liquid, pasty, and solid and, in so doing, the plurality of elongate treatment elements are subjected to one of a physical process, a chemical hardening process, and a melting process.

17. The method of claim 16, wherein the step of applying includes applying the plurality of elongate treatment elements completely layer-by-layer.

18. The method of claim 16, wherein the material applied layer-by-layer is pulverulent and includes at least one of a metal and a metal compound.

19. The method of claim 16, wherein the material applied layer-by-layer is one of sintered and melted by way of a laser.

20. The method of claim 16, wherein the material applied layer-by-layer is adhesively bonded by way of a binder and one of sintered and melted in a further method step.

* * * * *